United States Patent [19]

Matney

[11] 4,356,919

[45] Nov. 2, 1982

[54] HANG HOLE DEVICE FOR DISPLAY OF PACKAGE

[76] Inventor: Arthur Matney, 360 Furman St., Brooklyn, N.Y. 11201

[21] Appl. No.: 262,440

[22] Filed: Apr. 23, 1981

[51] Int. Cl.[3] ..... B65D 73/00

[52] U.S. Cl. ..... 206/470; 206/493; 206/806

[58] Field of Search ..... 206/470, 493, 806, 461, 206/467, 486, 489, 485

[56] References Cited

U.S. PATENT DOCUMENTS 3,025,958 3/1962 Snape ..... 206/806

FOREIGN PATENT DOCUMENTS 2407587 8/1975 Fed. Rep. of Germany ..... 206/806

2706001 8/1978 Fed. Rep. of Germany ..... 206/806

*Primary Examiner*—Joseph Man-Fu Moy

*Attorney, Agent, or Firm*—Abraham A. Saffitz

[57] ABSTRACT

A hang hole device for display of a multiple hinged package which comprises a flat sheet cut at its forward edges to fit within the confined contour of the inner side walls and front wall of the package with the rear edge cut to form a projecting tab whose width is the distance between adjacent hinges and which flat sheet is provided with a hole adjacent the rear edge to mount the inserted sheet and container on a spike in a display stand. The thickness of the flat cut hang hole sheet is such that it gives suitable strength and stability for hanging display yet is not too thick so as to damage the hinges. The flat sheet may be transparent or opaque and may be composed of plastic, paper or cardboard.

9 Claims, 6 Drawing Figures

HANG HOLE DEVICE FOR DISPLAY OF PACKAGE

BACKGROUND OF THE INVENTION

1. Field of the Invention

This invention relates to containers in which the structure is modified to effect a locked condition, the unlocking not being effected by conventional means but generally by manipulation of container itself. In the present invention, the manipulation of the locked condition into the unlocked condition is by thumb and forefinger opening of the latch. This definition is the precise definition of Class 206, subclass 1.5.

The invention also lies in the field of display containers in which there is a device provided for a storage container to make it convertible to a display device by means forming part of the container itself. In the present invention, the stiff transparent or opaque plastic sheet or cardboard is a part of the container which serves to convert the container to a display device by reasons of the hang hole in the projecting portion. This aspect of the invention comes under the definition of Class 206, subclass 44.

Illustrative of a patent in Class 206, subclass 204, is Wise, U.S. Pat. No. 3,186,557 which shows a rectangular container. It has a hinge in the back. It holds a razor. When the case is opened a stiff sheet is mounted adjacent the hinge. This stiff sheet can be used to hang various articles. The present invention is different from Wise, 3,186,557.

A second example is Rudolph et al. U.S. Pat. No. 3,738,723 which shows a stiff cardboard sheet in the back, sheet 7 of FIG. 1, the container being a rectangular container formed of plastic. The purpose of the stiff sheet 7 is to hang the box. However, this container is a very special construction to dispense pills, doesn't have a hinge in back and a latch in front and in no way accomplishes the purpose in the same way.

DESCRIPTION OF THE PRIOR ART

Snap, U.S. Pat. No. 3,025,958, discloses and claims a pilfer proof case for a safety razor and a blade package with external slots at one end of a receptacle. A pivoted cover connected to the receptacle and a destructible card between the cover and the receptacle having a resilient anchor portion which is biased toward an angular relation with respect to the card as a whole and an outer portion of the card arranged to overlie external slots of the receptacle.

In contrast, the present invention provides a device which has no folds and extends to the front edge of the container.

Other references of interest are summarized below:

| Name | Number | Remarks |
|---|---|---|
| Sutcliffe | 1,785,988 | Display bored for washers |
| Scott | 3,487,915 | Hang hole in panel 10, FIG. 4 aligns with hole 32 |
| Pharris | 3,591,299 | Paint tray and applicator. Cited to show aperture in back wall for applicator |
| Gwozdz | 3,695,418 | Keyhole slot |
| Bodolay, et al. | 3,844,409 | Two compartment package with shelf for card and hang hole |
| Colgate | 2,108,278 | Card extends from under base of container |

OBJECTS OF THE INVENTION

An object of the invention is to provide a low-cost, efficient device for converting a hinged container having several spaced apart hinges and which is generally rectangular construction with a flat sheet device having a projecting portion adapted to pass between the upper and lower covers of the hinged container and thereby convert the container into a display container by virtue of the provision of a hang hole which is provided within the projecting portion of the device.

A further object of the invention is to provide a transparent flat, hang hole device cut from a unitary sheet of plastic to convert the package into a display package.

Other and further objects will be apparent from the following description and the appended drawings.

SUMMARY OF THE INVENTION

A hang hole device for converting a multiple hinged container or package into a display container, said hang hole device comprising a flat sheet cut to fit within the inner wall confines of the container and having a projection in the form of a tab narrower in width than the width of the container, the tab fitting between the top cover and bottom of the container and between the hinges to project outwardly from two adjacent hinges with the container closed. This tab is provided with a hang hole near the edge and centered so that with the container closed the tab will support the container on a vertical support.

In one preferred embodiment the hang hole sheet device of the invention is fitted into a locked special cosmetic kit of rectangular shape enclosing eye shadow trays filled with various colorants for application with at least one applicator which is retained by the hang hole sheet device. In this embodiment the hang hole sheet device is formed of transparent flat sheet plastic material between and about 6 mils and 20 mils in thickness, which for the viewing of the special contents permits the color and shade of the cosmetic to be viewed through the transparent top while the kit is suspended by the hang hole on a spike or hook of a display slant. The thickness of 6–20 mils is that of the opening between top and bottom of the kit.

In another preferred embodiment the hang hole sheet device of the invention is used with a generally rectangular cosmetic kit having only one applicator in a cradle and in this embodiment of the kit vertical ribs of the bottom are formed in a tray which contains cosmetics adapted to be applied by the user with a single applicator with the cosmetic contents in a tray at the bottom of the kit.

In still another preferred embodiment the kit is used for cosmetics but is in the shape of an octagon, e.g., a rectangle or square with the corners cut by parallel diagonals. In this embodiment the hang hole device is cut with the edges generally lying within but close to the walls of the kit so that with the kit closed by the catch or latch at the front, the hang hole sheet serves to display the kit on the spike or hook of a display stand, permitting the kit to hang from the tongue portion which includes the hang hole.

It is seen that the various embodiments of kits all have in common multiple adjacent hinges at the back and a latch or catch at the front, multiple wells or recesses for cosmetic material and the capability of accommodating a pre-cut tongue between top and bottom, the tongue projecting from the sheet material constituting the hang hole device with hole means in the tongue for display, there being no other means for suspending the kit, covering the kit or reinforcing the kit other than the kit itself and the hang hole sheet device inserted into the kit in locked condition.

Obviously it is within the scope of the invention to repair a defective latch or catch with adhesive tape. Repair would not avoid the use of the hang hole device of the invention.

Further it is within the scope and spirit of the invention that it be used with kits other than cosmetic kits. Small articles of hardware such as sized screws, nails, grommets, fasteners, each size in a recess provided as with a cosmetic case for the specific rouge, colorant, power and the like are obviously adapted for display in containers which may be transparent at the top or opaque using the hang hole sheet device of the present invention.

DESCRIPTION OF THE PREFERRED EMBODIMENTS

Figure 1:
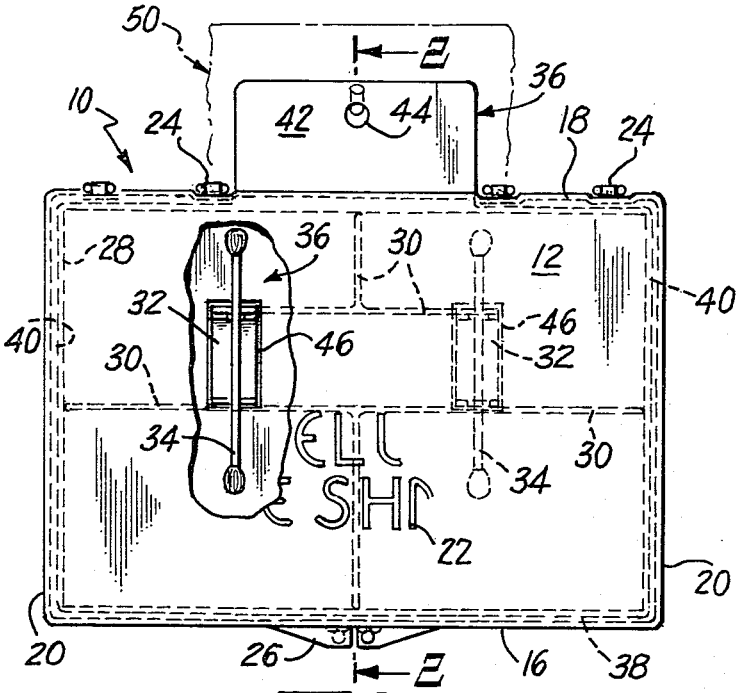
FIG. 1 is a front elevational view of a container in display position with the hang hole sheet device in accordance with the invention.
Figure 2:
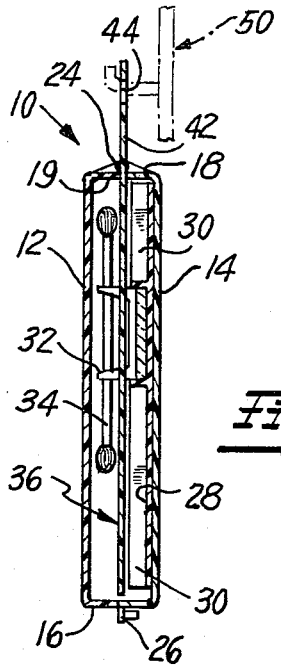
FIG. 2 is a vertical section view taken along the line 2—2 of FIG. 1 in which the hang hole sheet device of FIG. 1 is shown in its intended location and its assembled position.
Figure 3:
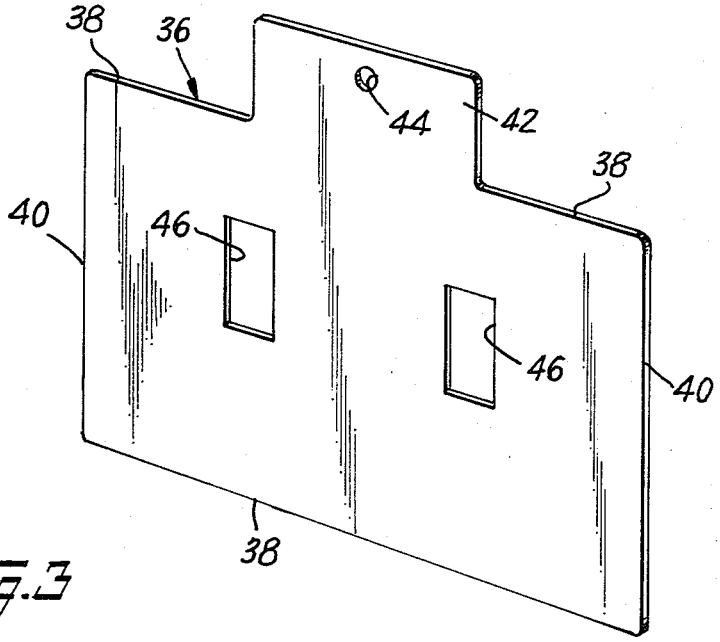
FIG. 3 is a perspective view of the hang hole sheet device of FIG. 1 by itself.

In FIGS. 1–3 there is shown a first preferred embodiment of the invention in which the hang hole device of the invention 36 is used with a multiple hinged package of the type used for cosmetics, eye shadow kit 10 bearing indicia 22 to indicate the contents and identify the source. The multiple hinge container 10 comprises a top 12, a bottom 14, a front 16 which is shown closed and a back 18. In the closed container 10 there is a clearance 19 between the top and bottom adjacent hinges 24.

This clearance being such as to permit the passage of a portion of the hang hole sheet 36, namely, the protecting tongue 32 between hinges 24. The thickness of the hang hole flat sheet 36 is such that when it projects through the clearance 19 it will not spring the hinges when the container is opened by manipulation of the catch 26 and the top 12 swing back. In the embodiment shown in FIGS. 1–3 the protecting tongue has a width which is slightly less than the width between the adjacent hinges so as to fit in the clearance 19.

The first preferred embodiment of the hang hole sheet 36 is transparent, but it may be colorless or it may be dyed and colored or it may be dyed at the edges in order to provide pleasing color effects within the container 10 which is also transparent. The tongue 42 contains a hole 44 and this hole serves to hang the entire assembly of hang hold device and container with catch 26 located into the hook of a display panel 50. (See FIG. 2) The advantage of the invention is readily understood in terms of the compact space occupying adaptation of the combination of hang hold sheet 36 and projecting tongue 42 to permit display in a very limited area. One of the most vital requirements for the small retail store or the large store, which has only a small amount of space for display items, is to permit display without losing valuable space and this objective is admirably accomplished by the present invention in a wholly new manner. The distinctions between the display by the present invention and those in the prior art can be seen from simply inspecting the display arranged in U.S. Patents Colgate No. 2,913,106, Snape No. 3,025,958 Wise No. 3,186,557, Pharris No. 3,591,299, Gwozdz No. 3,695,418, and Bodolay, et al. No. 3,844,409. Clearly the vertical space taken by the tongue in Pharris is many times greater than that in the invention. The cost of the special key hole slot hanger of Gwozdz is much greater than that of the hang hole in the invention. The bulk of the display in Wise makes it unsuitable for ordinary customer self-service operations. The complexity in cost of Colgate and Bodolay structures clearly distinguished these from the present invention.

A unique additional new structure and advantage is provided in the body portion of the sheet 36 in the form of the apertures 46 which serve to hold cradles 32 in which applicators 34 are supported. Two such apertures 46 are shown in the eye shadow kit, each applicator 34 supported on its cradle 32 and providing the absorbent sponge or equivalent absorbent ends which can be used with certain shades and thereby facilitate the skilled application of the cosmetic material.

Figure 4:
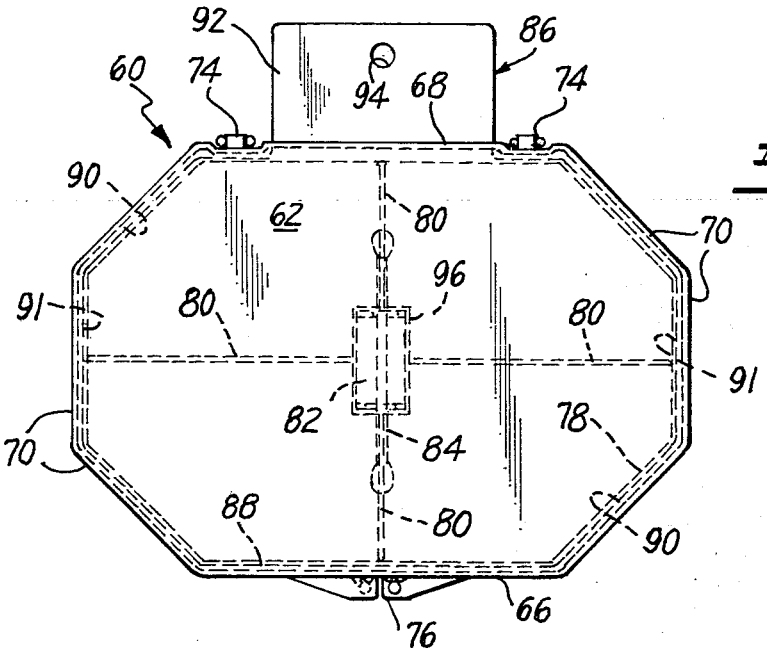
FIG. 4 is a modification showing a display container having an octagonal shape including the hang hole device of the invention.
Figure 5:
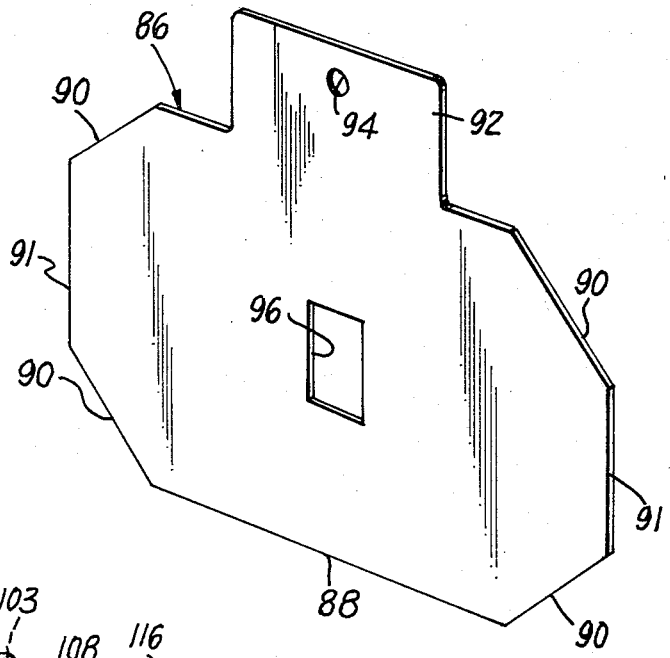
FIG. 5 is a perspective view of the hang hole sheet device of the FIG. 4 modification, by itself.

FIGS. 4 and 5 show a second type of cosmetic kit in which the container is not transparent but opaque and in which the rectangular shape is modified by having the corners of the container formed in the shape of an octagon rather than a rectangle. This embodiment of kit 60 has a top 62, a front 66 with its catch, a back 68, sides 70 and the adjacent hinges are in about the same relationship with respect to the distance between the hinges as in the first embodiment of FIGS. 1–3. The width of the projecting tongue portion 92 is about $\frac{1}{3}$ of the maximum width of the container. The rectangular shape of FIGS. 1–3 when replaced by the octagonal shape of FIGS. 4 and 5 would measure the width of FIG. 4 between the vertical sides 91 rather than at any point along the inclined sides 90. The long side 88 of the octagonal container in FIG. 4 is at the front of the kit 60 and serves to mount the catch 76, the parts of which are snapped shut by using the finger and thumb. In comparison with the straighter vertical sides 40, horizontal sides 38, and the relatively short height of the tongue 44 in FIGS. 1–3, the body portion of the hang hole sheet 86 is cut to conform to the inner octagonal sides of the kit 60 in FIGS. 4 and 5, namely, inclined sides 90, vertical sides 91 and the tongue 92 which projects from the body portion passes through the opening 94 between the adjacent hinges 74 at the rear of the kit.

In a manner which is similar to the provision of compartments for the cosmetic ingredients provided by the ribs 30 in FIGS. 1–3 for the first embodiment of cosmetic eye shadow, the second embodiment of FIGS. 4 and 5 also uses compartments defined by ribs 80.

The body portion of the hang hole sheet 86, which is cut to assume the octagonal configuration is shown in FIG. 5, is provided with an aperture for a cradle 82 which supports a single applicator 84 having absorbent material at both ends. The cosmetic contents of the octagonal kit 60 may be of a different type or may be for a different market of eye shadow where the number of greater possibilities is less.

In the first and second embodiments of FIGS. 1 and 4 the contents are cosmetics but they may be other than cosmetics; examples are: small hardware, such as screws, fasteners or auto parts for garages where small elements must be cataloged, identified and systematically displayed in transparent kits.

Figure 6:
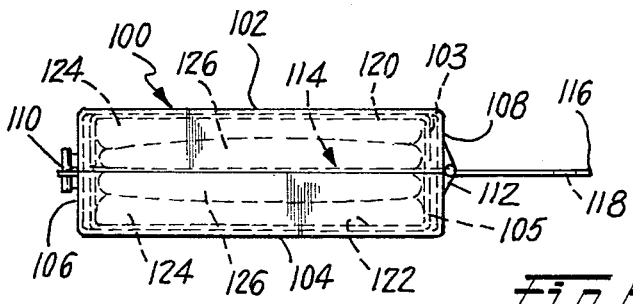
FIG. 6 is a side elevational view of a double decker rouge case having a flat hang hole sheet device of the present invention.

Still another type of embodiment is shown in FIG. 6 in which cosmetic kit 60 having a rectangular shape is used for a compact 100, the compact having top 102, an upper compartment 103, a bottom 104, a lower compartment 105, a front 106 with catch 110 and a back 108 with hinges 112. In this embodiment the hanger sheet 114 comprises a tongue 116 having the hole 118 which suspends the compact and hanger sheet from a display rack such as 50. The upper tray of 120 of the compact 100 contains a number of compartments in which there are placed rouge contents 124 in various shades. Each compartment has its own applicator 126. The lower tray 122 is similarly provided with rouge contents. Thus, a complete color complement shades can be provided in the upper and lower trays. This type of packaging provides a surprising variety of desirable cosmetic shades and hues to satisfy various needs for morning, afternoon and evening wear of the user without requiring a large comparison package. This rouge compact of FIG. 6 is excellent for travel purposes. The flat sheet hanger device 114 in FIG. 6 may be transparent. It may be opaque if the marketing requirements are such as to require that the contents be shielded from view and the color schemes and charts be explained by selling from a display device rather than from the item itself. Again the advantages in the display function of the prior art devices as explained with respect to the first and second embodiments above are also achieved with the compact in combination with the flat hanger device of FIG. 6.

Another advantage of all embodiments of the drawings is the cost savings in printing and marking on the hinged container itself. At the present time the inventor hot stamps the cases at the front to create his logo and to print his message concerning the goods. The hang hole sheet in its full length permits this message to be printed at very low cost yet one can see all of this information through the clear top of the case.

What is claimed is:

1. A hang hole device for display of a two hinged cosmetic package having walls, a top, a bottom and a front catch means comprising a flat sheet having a thickness adapted to pass between the top and bottom of the package;

said flat sheet having sides and a front portion cut to fit constituting a body portion within the walls of the package thereby providing a similar contour to the package;

said flat sheet having a back portion protruding from the back of the package between the top and bottom thereof and between two adjacent hinges to form a tongue adapted to hand said package on a display stand with the sheet in place;

the width of said tongue being slightly less than the distance between the two adjacent hinges;

said tongue including a hole in a center portion thereof to suspend the package from a display hook with the catch closed solely by said tongue; and said body portion providing means to accommodate an applicator for applying a cosmetic contained in the package for use by a purchaser, said applicator being protected at its ends by said body portion.

2. A hang hole device as claimed in claim 1 wherein the thickness of said sheet is between about 6 mils and up to about 20 mils, said thickness being less than that which could spring the hinges.

3. A hang hole device as claimed in claim 1 wherein said sheet is formed of paperboard.

4. A hang hole device as claimed in claim 1 wherein said sheet is formed of plastic sheet material.

5. A hang hole device as claimed in claim 1 wherein said sheet is formed of transparent plastic sheet material.

6. A hang hole device as claimed in claim 1 wherein said sheet is formed of transparent eyed plastic sheet material.

7. A hang hole device as claimed in claim 1 wherein said body portion is provided with two spaced apart apertures for two applicators.

8. A hang hole device as claimed in claim 1 wherein said package is rectangular and said body portion is rectangular in shape, the width of the tongue being about $\frac{1}{3}$ of the width of the package.

9. A hang hole device as claimed in claim 1 wherein said package is octagonal in shape and said body portion is also octagonal.

* * * * *